US009165541B2

(12) United States Patent
Pires

(10) Patent No.: US 9,165,541 B2
(45) Date of Patent: Oct. 20, 2015

(54) PERCUSSION INSTRUMENT

(76) Inventor: Mark Pires, Fairfield, CT (US)

( * ) Notice: Subject to any disclaimer, the term of this patent is extended or adjusted under 35 U.S.C. 154(b) by 545 days.

(21) Appl. No.: 13/543,480

(22) Filed: Jul. 6, 2012

(65) Prior Publication Data

US 2013/0177174 A1 Jul. 11, 2013

Related U.S. Application Data

(60) Provisional application No. 61/504,996, filed on Jul. 6, 2011.

(51) Int. Cl.

| | |
|---|---|
| ***G10H 1/00*** | (2006.01) |
| ***G10D 13/00*** | (2006.01) |
| ***G10D 13/02*** | (2006.01) |

(52) U.S. Cl.

CPC ..... *G10D 13/00* (2013.01); *G10D 13/02* (2013.01)

(58) Field of Classification Search

CPC ... G10D 13/02; G10D 13/006; G10D 13/021; G10G 1/00; G10G 5/00; G10G 7/005; G10H 1/32; G10H 2210/271; G10H 2220/015; G10H 2230/275; G10H 2230/27

USPC ..... 381/56, 118, 12, 182, 186, 307, 322, 381/61, 63; 84/291, 411 R, 327, 421, 387 A, 84/452 R, 240, 290, 294, 307, 385 P, 410, 84/453, 458, 616, 630

See application file for complete search history.

(56) References Cited

U.S. PATENT DOCUMENTS

| | | | | |
|---|---|---|---|---|
| 3,263,551 | A | 8/1966 | Musser | |
| 5,385,075 | A | 1/1995 | Carnes et al. | |
| 7,601,901 | B2 * | 10/2009 | Payerl | 84/411 R |
| 8,263,848 | B2 | 9/2012 | Aspland | |
| 2010/0031802 | A1 | 2/2010 | Millender, Jr. et al. | |
| 2011/0296973 | A1 * | 12/2011 | Herrera | 84/411 R |
| 2012/0073420 | A1 * | 3/2012 | Schmader | 84/415 |
| 2013/0068083 | A1 * | 3/2013 | Eduardo | 84/411 R |
| 2013/0177174 | A1 | 7/2013 | Pires | |

FOREIGN PATENT DOCUMENTS

| | | |
|---|---|---|
| WO | 2013116317 A1 | 8/2013 |

* cited by examiner

*Primary Examiner* — Akelaw Teshale
(74) *Attorney, Agent, or Firm* — Cantor Colburn LLP

(57) ABSTRACT

A percussion instrument is provided. The percussion instrument having: a seat; a pair of sidewalls extending downwardly from the seat towards a bottom of the percussion instrument, each of the pair of sidewalls providing a first tone when contacted; a forward surface extending from the seat and located between the pair of sidewalls, the forward surface providing a second tone when contacted, the second tone being higher than the first tone.

18 Claims, 5 Drawing Sheets

PERCUSSION INSTRUMENT

CROSS REFERENCE TO RELATED APPLICATIONS

This application claims the benefit of U.S. Provisional Patent Application Ser. No. 61/504,996, filed Jul. 6, 2011, the contents of which are incorporated herein by reference thereto.

BACKGROUND

Exemplary embodiments of the present invention relate to a percussion instrument that can be utilized as a seat as well as being struck by both feet and hands of a user of the instrument. In addition, the percussion instrument can be used in conjunction with another musical instruments including but not limited to guitars, piano, bass or any other musical instrument.

Solo musicians strive to provide live performances that emulate sounds produced by bands having multiple musicians playing multiple instruments. Moreover, individual musicians continuously strive for seats suitable for use as a seat without interfering with the playing of their instruments.

Accordingly, it is desirable to provide a percussion instrument that can function as both a seat as well as a complement to another instrument being played by the user who is sitting on the seat.

SUMMARY

According to embodiment, a percussion instrument is provided. The percussion instrument having: a seat; a pair of sidewalls extending downwardly from the seat towards a bottom of the percussion instrument, each of the pair of sidewalls providing a first tone when contacted; a forward surface extending from the seat and located between the pair of sidewalls, the forward surface providing a second tone when contacted, the second tone being higher than the first tone.

In another embodiment, a seat and a percussion instrument is provided. The seat being supported by a pair of sidewalls of the instrument and each of the pair of sidewalls providing a first tone when contacted. A forward surface extends from the seat and is located between the pair of sidewalls, the forward surface providing a second tone when contacted, the second tone being higher than the first tone.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
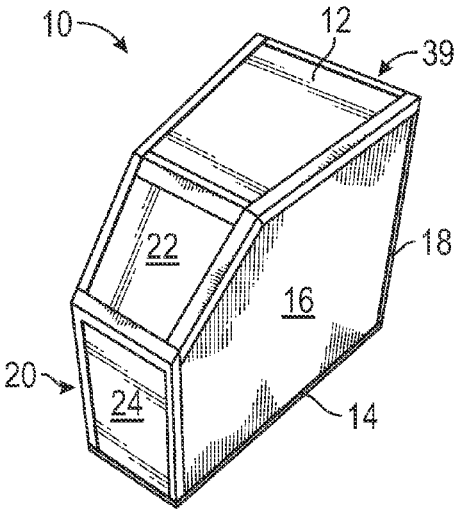
FIGS. 1-6 are various perspective views of a percussion instrument in accordance with an exemplary embodiment of the invention.
Figure 2:
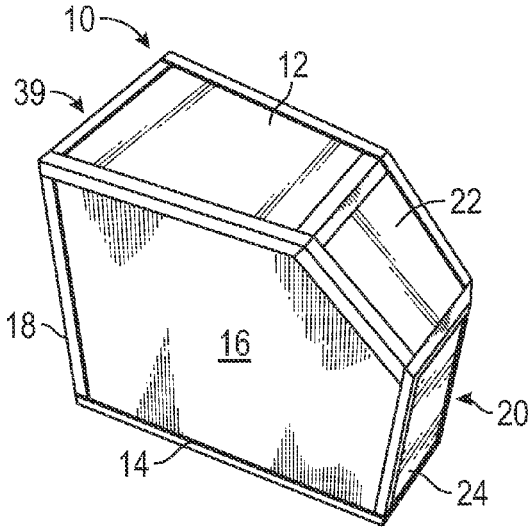
Figure 3:
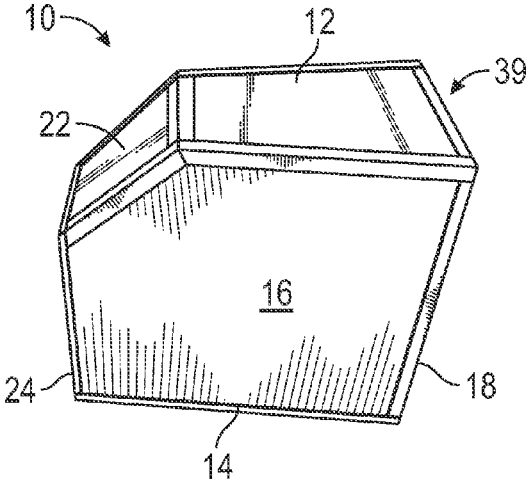
Figure 4:
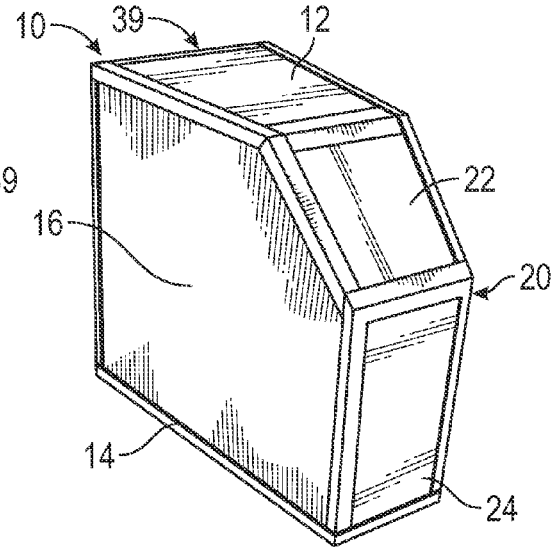
Figure 5:
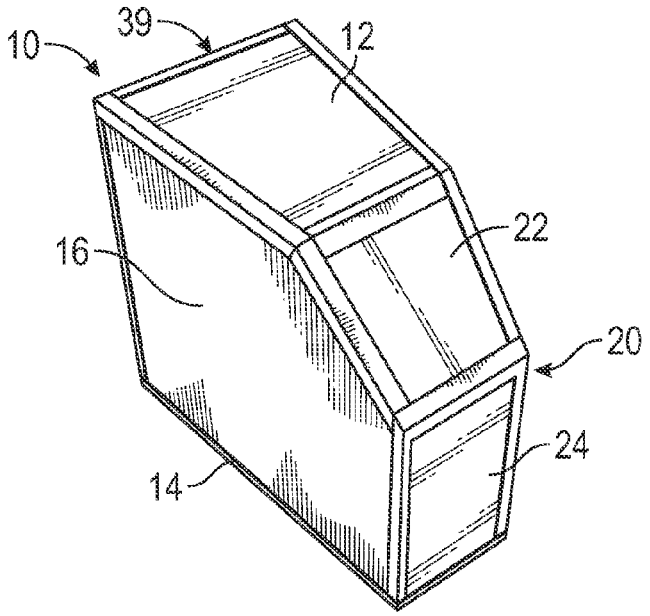
Figure 6:
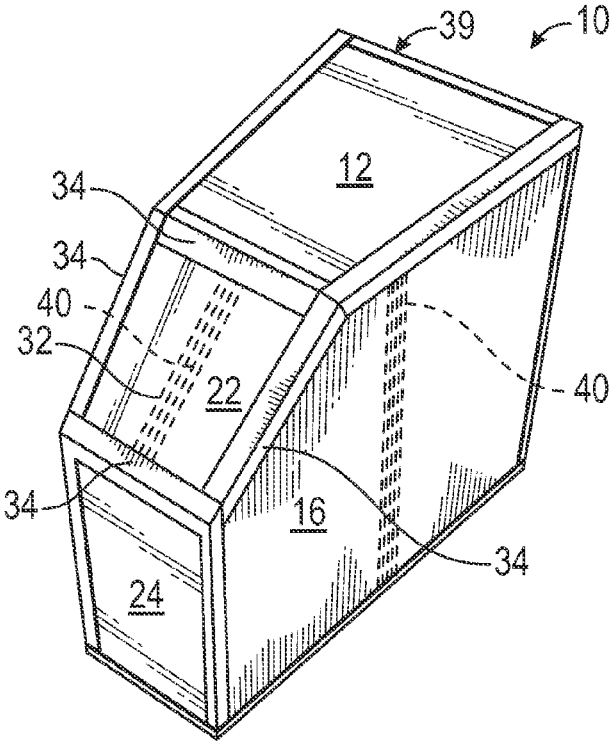
Figure 8:
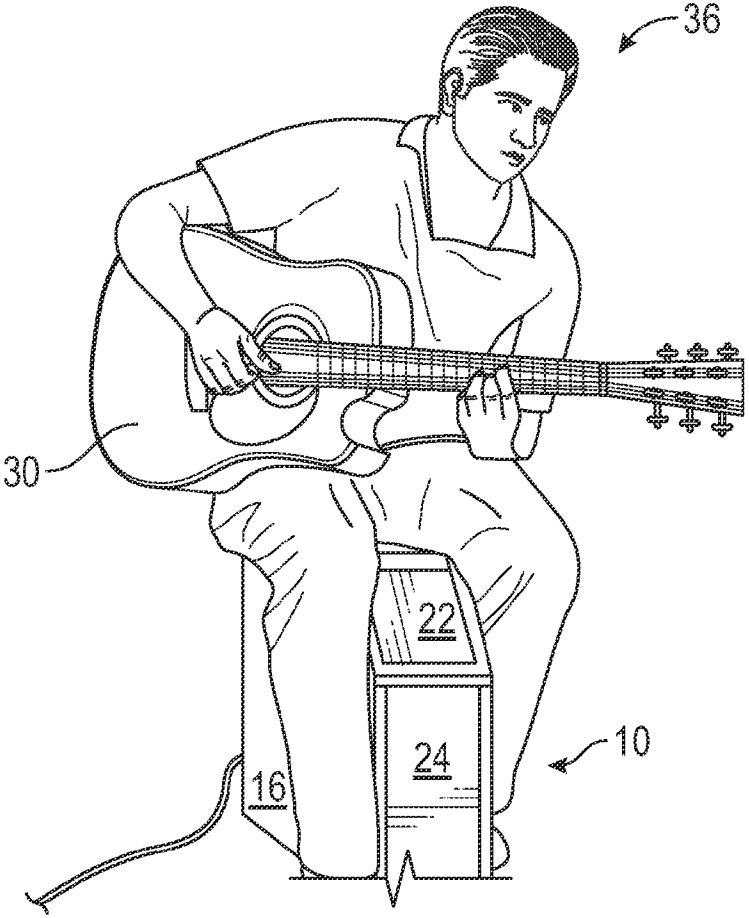
FIGS. 7 and 8 are views illustrating an individual sitting on the percussion instrument in accordance with an exemplary embodiment of the present invention.
Figure 7:
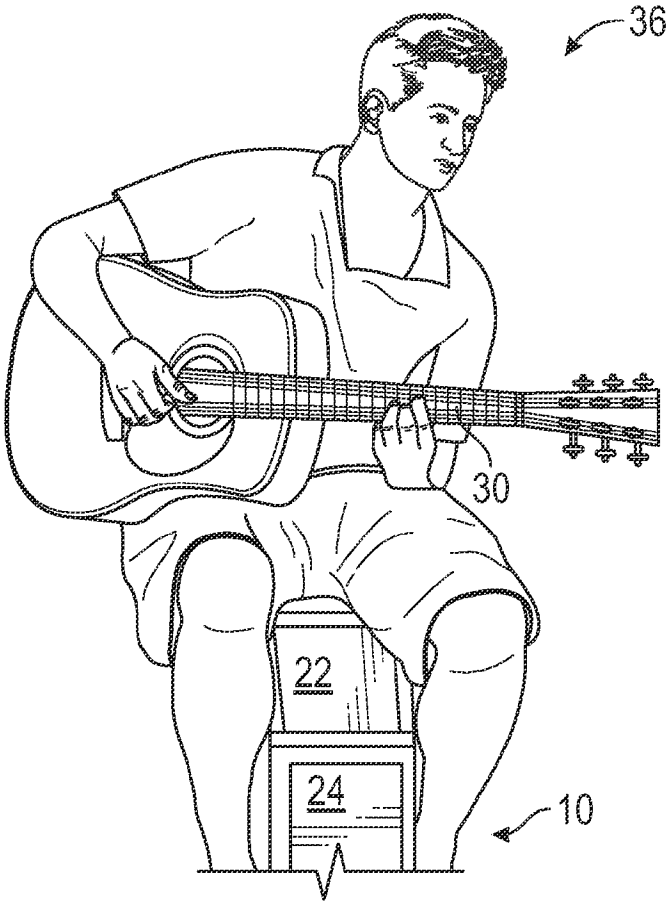
Figure 9:
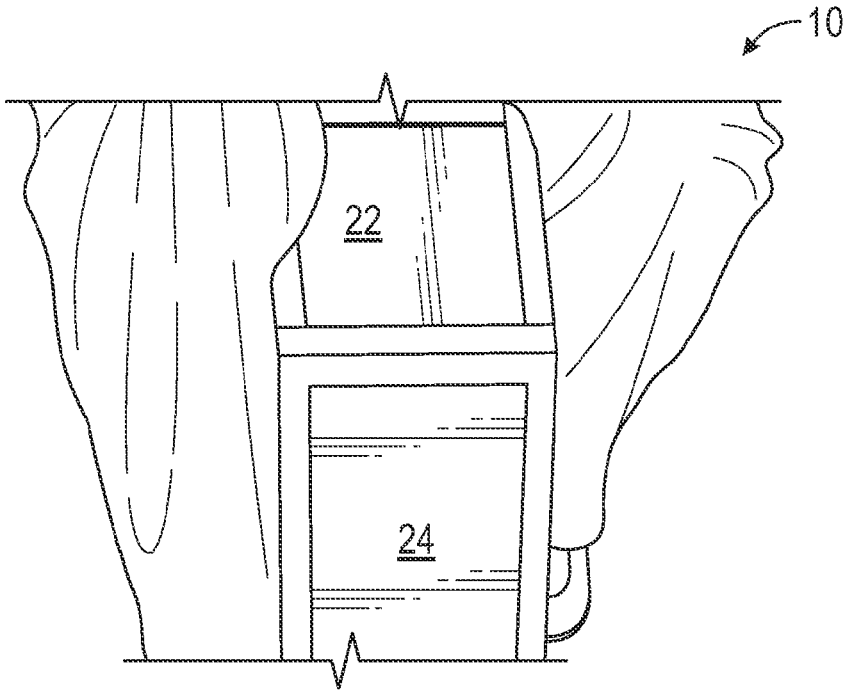
FIGS. 9 and 10 are forward views of the percussion instrument in accordance with an exemplary embodiment of the present invention.
Figure 10:
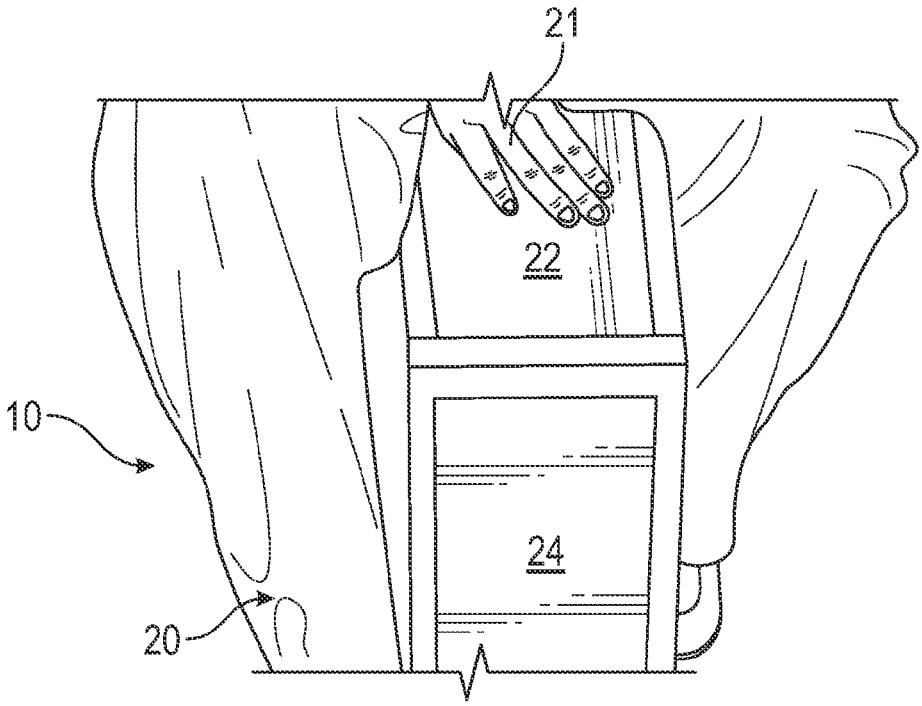
Figure 11:
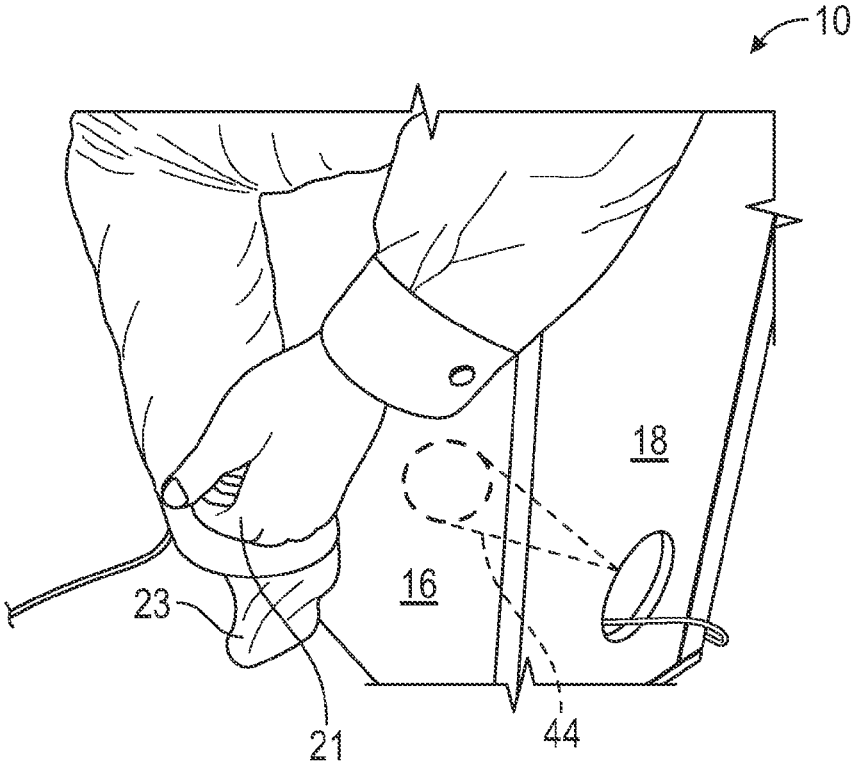
FIGS. 11 and 12 are rearward views of the percussion instrument in accordance with an exemplary embodiment of the present invention.
Figure 12:
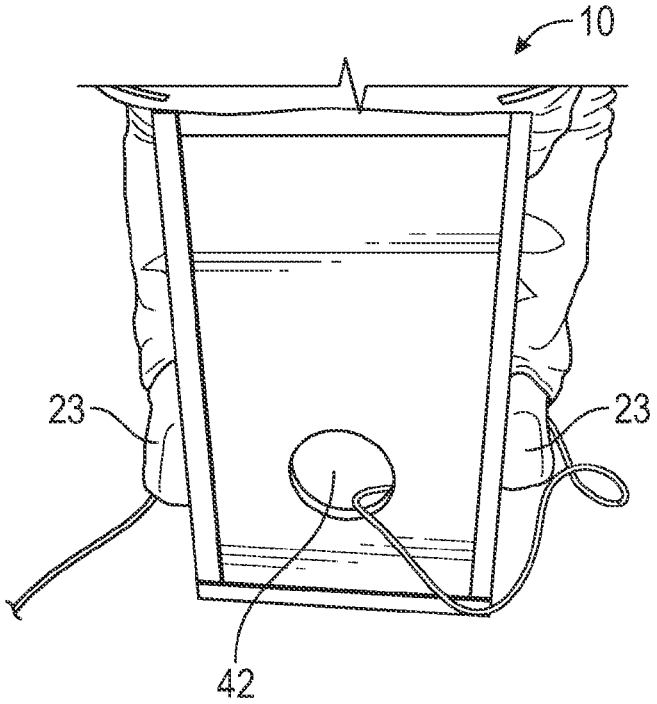

As illustrated in FIGS. 1-12, a percussion instrument 10 is illustrated. In accordance with one non-limiting exemplary embodiment the percussion instrument 10 has an upper surface 12, a bottom 14, a pair of sidewalls 16 extending between the upper surface 12 and the bottom 14. In one embodiment, upper surface 12 acts like a seat for use by an individual sitting upon the percussion instrument 10. In addition, the percussion instrument 10 has a back panel or wall 18 extending between the upper surface 12 and the bottom 14. At a forward or front side 20, the percussion instrument 10 has an angled surface 22 extending from the upper surface 12 to a forward wall portion 24 that extends from one end of the angled surface 22 to the bottom 14 of the percussion instrument 10.

In one implementation, the percussion instrument 10 is hollow such that impacts upon anyone of the surfaces will provide various tones. For example and in one non-limiting exemplary embodiment, the sidewalls 16 provide lower tones or bass tones when impacted by feet or hands of an individual 36 sitting upon seat 12 of the percussion instrument. Still further and due to the configurations of the percussion instrument 10, a user of the same can vary the tones produced by contacting the sidewalls 16 by playing or contacting forward, backward, upper or higher or downward and lower locations on the sidewalls 16 of the percussion instrument 10.

Surface 22 provides a "snare" like tone when impacted by a user's hands. The location of surface 22 (e.g., at the forward end 20 of the percussion instrument 10) allows for easy access to a user's hands 21 while they are sitting on the percussion instrument 10 and playing another instrument 30. Moreover, impacts at the center 32 of surface 22 will provide different tones than those made at the periphery 34 or close to the periphery 34 of surface 22. As such, an individual 36 playing the musical instrument 30 can impact the sidewalls 16 in order to provide percussion or drum sounds while playing the instrument 30. Still further, the individual 36 can also impact surface 22 to provide additional percussion sounds while playing instrument 30.

In accordance with various exemplary embodiments of the present invention, the percussion instrument 10 can be configured to have various dimensions that will affect the tones made when surfaces of the instrument are contacted. Still further, the percussion instrument can be made from numerous materials that will also affect the sounds or tones made when surfaces of the instrument are contacted. Moreover, different materials may be used for different surfaces in order to have variations in the sounds made. For example, the sidewalls 16 maybe formed from a first material while surface 22 is formed from a second material such that impacts upon the different surfaces will provide different tones or sounds. Of course, the same material can be used for all surfaces and the varying dimensions as well as thickness of the material used for the impact surfaces may vary the sounds being produced. Accordingly, the percussion instrument 10 can provide numerous drum like instruments each having different sounds. For example, the sidewalls 16 can act as bass drums while surface 22 can act like a snare drum. Still other alternative drum sounds could be those similar to toms-toms, etc. Still further each of the sidewalls 16 can have different surfaces to provide different sounds when impacted.

As illustrated in the attached FIGS., the dimensions of the percussion instrument 10 can vary so as to provide the aforementioned different tones when the sidewalls 16 or surface 22 are struck. For example, the rear portion 39 of the percussion instrument 10 may have a wider dimension than the forward portion 20 thus providing a more narrow width at the forward end of the percussion instrument 10. Moreover, surface 22 may also be configured to have a wider dimension towards the top of the percussion instrument 10 (e.g., closer to surface 12) and taper to a more narrow dimension at the bottom of surface 22 proximate to its contact with surface 24. Still further and as illustrated in the FIGS. the dimensions (e.g., width and height) of the percussion instrument 10 are such that a user 36 can sit upon surface 12 and have the sidewalls 16 located between the users legs such that the surfaces of sidewalls 16 can be impacted by the user's feet, hands, knees, etc. In addition, surface 22 is also located such that it can be also impacted by the user's hands, knees, etc.

Non-limiting examples of materials used for the surfaces of the cushion instrument include woods, composite materials, plastics, nylon, equivalents thereof and combinations thereof.

In order to enhance the sounds made when anyone of the surfaces 22, 16, etc. of the percussion instrument 10 are impacted a shaker 40 is secured adjacent to an inner surface of the surfaces such that "snare-like" sounds are made. In one embodiment, the shaker 40 is a plurality of strands of beads, metal strings or any other suitable item secured proximate to an inner surface of anyone of the surfaces of the percussion instrument 10 such that rattling noises are made when the opposite side of the surface containing the shaker 40 is impacted. In one embodiment, the tension of the strings may be adjustable to provide varying noises. In one embodiment, surface 22 is equipped with a shaker 40 and sidewalls 16 are bass sounding surfaces. Alternatively, one or both of the sidewalls 16 are provided with a shaker 40. The locations of the shaker 40 in the attached FIGS. are merely provided as examples and the size and location of shaker 40 may vary.

In yet another embodiment, the rear wall or back panel 18 is provided with an opening 42 such that a microphone 44 or other device can be inserted into the internal compartment of the percussion instrument such that sounds of the same may be amplified.

In accordance with various non-limiting exemplary embodiments of the present invention, the base tones are created on the left and right sides (sidewalls 16) with a user's feet 23 or hands 21 while snare or higher percussion sounds are created by impacts to a surface or surfaces located between a user's legs at the forward end of the percussion instrument 10. The unique configuration of the percussion instrument 10 allows for comfort while an individual is performing since the individual (e.g., musician) is sitting on the percussion instrument 10 and straddles the same thereby a housing their hands to be free to play another instrument (e.g., guitar, bass, piano, saxophone, etc.) or allow them to use both their hands and feet to strike the percussion instrument 10.

As mentioned above, the percussion instrument is wider at a rearward or back and in tapers towards the foreword or front end 20, which allows for different tones to be heard while the instrument 10 is played.

Various exemplary embodiments of the present invention allow musicians to add full, rich percussion to their gigs while also providing a consistent and comfortable seat while playing in venues large and small. The musician can sit on the percussion instrument 10 and play comfortably for hours.

As described above and in one non-limiting exemplary embodiment, the percussion instrument 10 is constructed with a bass panel on both left and right sides so an individual can use either their left or right foot to keep the beat or use both feet for a double bass sound. Located in the front between the user's legs is a snare drum which offers many different and distinct tones. In one non-limiting exemplary embodiment, the forward snare drum (e.g., surface 22) can provide at least nine distinct sounds.

The percussion instrument 10 allows solo musicians and artists to sound like a band by adding live percussion to performances and/or playing sessions. In addition, the cushion instrument 10 is extremely portable such that the musician can bring it with them from venue to venue relatively easily due to its limited size and profile.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims. Lastly, the terms "comprising," "including," "having," and the like, as used in the present application, are intended to be synonymous unless otherwise indicated. This written description uses examples to disclose the invention, including the best mode, and to enable any person skilled in the art to practice the invention, including making and using any devices or systems. The patentable scope of the invention is defined by the claims, and may include other examples that occur to those skilled in the art. Such other examples are not intended to be within the scope of the claims, or if they include equivalent structural elements with insubstantial differences from the literal languages of the claims.

What is claimed is:

1. A percussion instrument, comprising:

a seat;

a pair of sidewalls extending downwardly from the seat towards a bottom of the percussion instrument, each of the pair of sidewalls having a surface area that provides a first tone when contacted;

a forward surface extending from the seat and located between the pair of sidewalls, the forward surface having a forward surface area that provides a second tone when contacted, the second tone being higher than the first tone, wherein the surface area is larger than the forward surface area; and a forward wall extending upwardly from the bottom towards the forward surface, wherein the pair of side walls and the forward wall extend vertically from the bottom and the forward surface is angularly disposed with respect to the forward wall and the seat such that an inclined surface is provided between the pair of sidewalls.

2. The percussion instrument as in claim 1, wherein the pair of sidewalls and the forward surface are formed from wood.

3. The percussion instrument as in claim 1, wherein a hollow cavity is defined by at least the pair of sidewalls and the forward surface.

4. The percussion instrument as in claim 1, further comprising a shaker located adjacent an inner surface of the forward surface.

5. The percussion instrument as in claim 4, wherein each of the pair of side walls extend from the first width to the second width.

6. The percussion instrument as in claim 1, further comprising a shaker located adjacent an inner surface of at least one of the pair of sidewalls.

7. The percussion instrument as in claim 6, wherein the seat is tapered such that a rearward portion of the seat is wider than a forward portion of the seat.

8. The percussion instrument as in claim 1, wherein a forward end of the percussion instrument comprising the forward surface has a first width and a rearward end of the percussion instrument has a second width, the second width being greater than the first width.

9. A musical instrument, comprising: a seat and a percussion instrument, wherein the seat is supported by a pair of sidewalls and each of the pair of sidewalls extending downwardly from the seat towards a bottom of the percussion instrument and having a surface area that provides a first tone when contacted;

a forward surface extending from the seat and located between the pair of sidewalls, the forward surface having a forward surface area that provides a second tone when contacted, the second tone being higher than the first tone, wherein the surface area is larger than the forward surface area; and a forward wall extending upwardly from the bottom towards the forward surface, wherein the pair of side walls and the forward wall extend vertically from the bottom and the forward surface is angularly disposed with respect to the forward wall and the seat such that an inclined surface is provided between the pair of sidewalls.

10. The instrument as in claim 9, wherein the pair of sidewalls and the forward surface are formed from wood.

11. The instrument as in claim 9, wherein the forward surface is angularly disposed with respect to the pair of sidewalls.

12. The instrument as in claim 9, wherein a hollow cavity is defined by at least the pair of sidewalls and the forward surface.

13. The instrument as in claim 12, further comprising a microphone located within the hollow cavity.

14. The instrument as in claim 9, further comprising a shaker located adjacent an inner surface of the forward surface.

15. The instrument as in claim 9, further comprising a shaker located adjacent an inner surface of at least one of the pair of sidewalls.

16. The instrument as in claim 9, wherein a forward end of the percussion instrument comprising the forward surface has a first width and a rearward end of the percussion instrument has a second width, the second width being greater than the first width.

17. The instrument as in claim 16, wherein each of the pair of side walls extend from the first width to the second width.

18. The instrument as in claim 16, wherein the seat is tapered such that a rearward portion of the seat is wider than a forward portion of the seat.

* * * * *